US012091733B2

(12) United States Patent
Li et al.

(10) Patent No.: US 12,091,733 B2
(45) Date of Patent: Sep. 17, 2024

(54) ULTRA-CLEAN RARE EARTH STEEL AND OCCLUDED FOREIGN SUBSTANCE MODIFICATION CONTROL METHOD

(71) Applicant: INSTITUTE OF METAL RESEARCH CHINESE ACADEMY OF SCIENCES, Liaoning (CN)

(72) Inventors: Dianzhong Li, Liaoning (CN); Yikun Luan, Liaoning (CN); Hongwei Liu, Liaoning (CN); Paixian Fu, Liaoning (CN); Xiaoqiang Hu, Liaoning (CN); Pei Wang, Liaoning (CN); Lijun Xia, Liaoning (CN); Chaoyun Yang, Liaoning (CN); Hanghang Liu, Liaoning (CN); Yang Liu, Liaoning (CN); Peng Liu, Liaoning (CN); Yiyi Li, Liaoning (CN)

(73) Assignee: INSTITUTE OF METAL RESEARCH CHINESE ACADEMY OF SCIENCES, Shenyang (CN)

( * ) Notice: Subject to any disclaimer, the term of this patent is extended or adjusted under 35 U.S.C. 154(b) by 0 days.

(21) Appl. No.: 18/142,152

(22) Filed: May 2, 2023

(65) Prior Publication Data

US 2023/0295780 A1 Sep. 21, 2023

Related U.S. Application Data

(62) Division of application No. 17/611,061, filed as application No. PCT/CN2019/108858 on Sep. 29, 2019, now abandoned.

(30) Foreign Application Priority Data

Sep. 10, 2019 (CN) ..... 201910855025.2

(51) Int. Cl.
*C22C 38/00* (2006.01)
*C21C 7/00* (2006.01)
(Continued)

(52) U.S. Cl.
CPC ..... *C22C 38/005* (2013.01); *C21C 7/0006* (2013.01); *C21C 7/04* (2013.01);
(Continued)

(58) Field of Classification Search
CPC ..... C22C 38/005; C22C 33/04; C22C 38/004; C22C 33/06; C21C 7/0006; C21C 7/04;
(Continued)

(56) References Cited

FOREIGN PATENT DOCUMENTS

CN 106609313 A * 5/2017

OTHER PUBLICATIONS

CN106609313A Translation (Year: 2017).*

* cited by examiner

*Primary Examiner* — Brian D Walck
*Assistant Examiner* — Danielle M. Carda

(57) ABSTRACT

A control process of inclusions in ultra-clean rare earth steel, wherein the content of rare earth elements REM in the ultra-clean rare earth steel, the total oxygen content T[O]m, the total sulfur content T[S]m in the steel, and the total oxygen content T[O]r in a rare earth metal or alloy added to the steel are controlled to satisfy the following formula: $-500<REM-(m*T[O]m+n*T[O]r+k*T[S]m)<-30$, where REM is the content of rare earth elements in the steel, in ppm; T[O]m is the total oxygen content in the steel, in ppm; T[O]r is the total oxygen content in a rare earth metal or alloy added to the steel, in ppm; T[S]m is the total sulfur content in the steel, in ppm; m is a first correction coefficient, with a value of 2-4.5;n is a second correction coefficient; and k is a third correction coefficient.

11 Claims, 1 Drawing Sheet

(51) Int. Cl.
*C21C 7/04* (2006.01)
*C21C 7/06* (2006.01)
*C22C 33/04* (2006.01)

(52) U.S. Cl.
CPC ..... *C21C 7/06* (2013.01); *C22C 33/04* (2013.01); *C22C 38/004* (2013.01)

(58) Field of Classification Search
CPC ..... C21C 7/06; C21C 7/076; C21C 7/10; C21C 7/068
USPC ..... 420/83
See application file for complete search history.

ULTRA-CLEAN RARE EARTH STEEL AND OCCLUDED FOREIGN SUBSTANCE MODIFICATION CONTROL METHOD

CROSS-REFERENCE TO RELATED APPLICATIONS

This Application is a divisional of application Ser. No. 17/611,061. The present application claims priorities from application Ser. No. 17/611,061, filed Nov. 12, 2021, from PCT Application No. PCT/CN2019/108858, filed Sep. 29, 2019, and from the Chinese patent application with the filing No. 201910855025.2, filed on Sep. 10, 2019 with the Chinese Patent Office, and entitled "Ultra-clean Rare Earth Steel and Occluded Foreign Substance Modification Control Method", the contents of which are incorporated herein by reference in entirety.

TECHNICAL FIELD

The present application belongs to the field of alloys, and relates to ultra-clean rare earth steel and an occluded foreign substance modification control method.

BACKGROUND OF THE PRESENT INVENTION

In recent decade, after the double low oxygen technology, i.e. simultaneously controlling an initial oxygen content of rare earth metal itself and a total oxygen content of a steel melt, is applied, the effect of rare earth becomes abnormally stable and prominent, and many earlier applications of the inventors present related technology, including: CN201610265575.5, relating to a method for preparing a high-purity rare earth metal, which can avoid the generation of coarse inclusions, property fluctuations of material, nozzle blockage during production, etc., but does not study the influence of the high-purity rare earth metal on inclusions in the steel; CN201611144005.7, relating to an extra-low oxygen rare earth alloy and use, wherein a high-purity rare earth alloy is used for treating steel, and a comparison diagram of treated inclusions and rating of the inclusions are given, but the influence of addition amount of the high-purity rare earth alloy on the size, number, and type of the inclusions fail to be figured out, so that the research, development and innovation of high-performance rare earth steel have been advanced slowly and even almost stagnated; CN201410141552.4, relating to a smelting method of ultra-low oxygen pure steel, wherein two times of vacuum carbon deoxygenation and further deoxygenation by adding rare earth are combined to reduce an oxygen content in a molten metal, reduce the number of inclusions in the alloy, improve the distribution of the inclusions, and relieve channel segregation, so that the product has fewer inclusions, the molten metal is pure, and the high-purity molten metal with an ultra-low oxygen content is obtained with high quality, but how to control the morphology, number, type and distribution of inclusions in the steel by adding the rare earth is not figured out; CN201610631046.2, relating to a method for adding rare earth metal into steel to improve performance, wherein by simultaneously controlling a molten steel to have T[O]s<20 ppm before adding the rare earth and the rare earth metal itself to have T[O]r<60 ppm, the problem of nozzle blockage is solved, and inclusion grains are refined, then the impact toughness of the steel is improved, but the influence of the rare earth addition on modification of the inclusions in the steel is not clear yet; CN201710059980.6, relating to a high-purity rare earth steel treatment method, wherein an addition amount of rare earth is based on dissolved oxygen $O_{dissolved\ oxygen}$, total oxygen T.O, a sulfur content S, refining slag alkalinity $R=CaO/SiO_2$, and a total content of FeO+MnO in a molten steel, but the relationship between the dissolved oxygen $O_{dissolved\ oxygen}$, the total oxygen T.O, the sulfur content S, the refining slag alkalinity R, the total content of FeO+MnO and the addition amount of rare earth and also the influence of the addition amount of rare earth on $O_{dissolved\ oxygen}$, T.O, S, R and the total content of FeO+MnO are not studied, then clear guidance on the production practice of different varieties of high-purity rare earth steel is lacked.

Nippon Steel CN1759199A relates to bearing steel containing fine inclusions, wherein oxide inclusions in the steel are converted into REM oxide inclusions by controlling an addition amount of REM to the bearing steel at $-30<REM-(T.O.\times 280/48)<50$, where 280/48 is obtained according to a stoichiometric ratio of REM to O in $REM_2O_3$, the addition amount of REM satisfies this formula, to prevent $Al_2O_3$ from not reacting, and convert the alumina inclusions in the steel into REM oxide. However, although the REM-oxygen-sulfide is mentioned in this document, the purpose of controlling the addition amount of REM is to address the formation of the REM oxide inclusions, fundamentally without consideration of the influence of the change of O content in the steel on the inclusions caused by the addition of REM, or the influence of the impurity element S or the like on the inclusions, and the resulting rolling contact fatigue life of pure bearing steel containing rare earth inclusions is 3.2-9.2 times that without the addition of REM.

The invention application 201811319185.7 of Cheng Guoguang et al. of University of Science and Technology Beijing pointed out that the rare earth Ce has a good modification effect on $MgAl_2O_4$, but only when the content of rare earth in the bearing steel is controlled to be 0.002% (i.e., 20 ppm), composite inclusions with $CeAlO_3$ coated by TiN are obtained, when the content of rare earth in the bearing steel reaches 0.004% (i.e., 40 ppm), types of main inclusions in the bearing steel are $Ce_2O_3$ and separate TiN inclusions, when the content of rare earth is increased to 0.007% (i.e., 70 ppm), the types of main inclusions in the bearing steel are also separate $Ce_2O_3$ and TiN. As the content of rare earth in the steel is further increased, $Ce_2O_3$ stably exists in the steel. Although the content of the inclusions TiN in the steel is reduced, lattice matching property between $Ce_2O_3$ and TiN inclusions is unfavorable, then the formation of a large amount of rare earth oxides instead deteriorates the mechanical properties of the steel.

Currently, the influence of the rare earth addition on the modification of the inclusions in the steel is not clear yet, the controllability after the rare earth addition is poor, and systematic in-depth research is lacked, then the production control process of the modification of inclusions is difficult and poor in stability, greatly restricting the promotion and application of the low-cost rare earth on the preparation of high-performance steel, such as bearing, gear, mold, stainless steel, steel for nuclear power, steel for automotive, and various key components.

SUMMARY OF THE PRESENT INVENTION

In order to realize precise control over the type, distribution and size of inclusions (occluded foreign substance) modification in steel after rare earth addition, and be adapted to research, development and production of more varieties of high-performance steel, the inventor team proposes ultra-clean rare earth steel containing a ppm-level rare earth element and a modification control method thereof through continuous research, development, innovations and close combination with engineering practice.

In order to achieve the above objective, the present application mainly provides the following technical solution:

In one aspect, an example of the present application provides ultra-clean rare earth steel, containing 10-200 ppm, preferably 10-100 ppm, more preferably 10-50 ppm, most preferably 15-40 ppm, of rare earth elements, and 50% or more, preferably 80% or more, and more preferably 95% or more, of total number of inclusions in the steel being RE-oxygen-sulfide ($RE_2O_2S$) with a mean equivalent diameter $D_{mean}$ of 1-5 μm, in a spherical shape or a spheroidal shape or a granular shape, and in dispersed distribution.

In the above, the RE-oxygen-sulfide has a gentle boundary with Fe matrix, and good compatibility with the Fe matrix.

In the above, the equivalent diameter is obtained from (maximum particle size+minimum particle size)/2 by measuring the inclusions.

Preferably, a rare earth content in the ultra-clean rare earth steel satisfies the following formula (1):

$$-500<REM-(m*T[O]m)+n*T[O]r+k*T[S]m)<-30 \quad (1).$$

In the above, REM is the content of rare earth elements in the steel, in ppm;

T[O]m is a total oxygen content in the steel, in ppm;

T[O]r is a total oxygen content in a rare earth metal or alloy added to the steel, in ppm;

T[S]m is a total sulfur content in the steel, in ppm;

m is the first correction coefficient, with a value of 2-4.5, preferably 3-4.5;

n is the second correction coefficient, with a value of 0.5-2.5, preferably 1-2.2; and k is the third correction coefficient, with a value of 0.5-2.5, preferably 1-2.2.

The research of the inventor team shows that: by specifying that the rare earth content REM in the ultra-clean rare earth steel, the total oxygen content and the total sulfur content in the molten steel, and the total oxygen content in the rare earth metal or alloy added to the steel satisfy the above formula (1), it can be obtained that fine and dispersed RE-oxygen-sulfide ($RE_2O_2S$) accounts for 50% or more, preferably 80% or more, 95% or more of the total number of inclusions, rather than rare earth oxide ($RE_2O_3$) predominating, and it is simultaneously ensured that the formed RE-oxygen-sulfide ($RE_2O_2S$) has a mean equivalent diameter of 1-5 μm, in a spherical shape, a spheroidal shape or a granular shape, and in dispersed distribution. The various correction coefficients above are empirical coefficients for ensuring the formation of $RE_2O_2S$.

After test, it was found that the tension-compression fatigue life of the REM-modified high-purity bearing steel is improved to $4.1*10^8$ times, which is more than 40 times that of the existing high-purity bearing steel, and the rolling contact fatigue life of the REM-modified high-purity bearing steel reaches $3.08*10^7$ times, which is 910 ten thousand times higher than that of the existing high-purity bearing steel, thus the fatigue life of the REM-modified high-purity bearing steel is significantly improved; compared with the conventional IF steel, the RE-IF steel has the r value significantly improved by 25%, and meanwhile the elongation and the product of strength and ductility of RE-IF steel obviously get improved without changing the strength thereof; compared with the high-strength steel without addition of RE, the ultra-high-strength steel is comprehensively improved in low-temperature transverse and longitudinal impact energies in the range of 0° C. to −40° C. after the addition of ultra-low content RE.

Preferably, the steel is high-level bearing steel, gear steel, mold steel, stainless steel, steel for nuclear power, IF/DP/TRIP steel for automobile, or ultra-high-strength steel.

On the other hand, the present application further provides ultra-clean rare earth steel containing 10-200 ppm, preferably 10-100 ppm, more preferably 10-50 ppm, of rare earth elements, and inclusions in the steel include, in number, 50% or more of rare earth-oxygen-sulfide ($RE_2O_2S$), 50% or less of rare earth-sulfide, and 0-10% of $Al_2O_3$ inclusions.

The present application further provides ultra-clean rare earth steel containing ppm-level rare earth elements, wherein 70% or more, preferably 80% or more, more preferably 95% or more, of the total number of inclusions in the steel are O—Al—S-RE and/or RE-O—S inclusions in a spherical shape or a spheroidal shape and in dispersed distribution, a sum of contents of TiN and MnS inclusions is 5% or less, and the inclusions have a mean equivalent diameter of 1-2 μm; further, the rare earth element content in the steel is 10-200 ppm, preferably 10-100 ppm, and more preferably 10-50 ppm.

A method of modifying inclusions in ultra-clean rare earth steel of the present application is modifying at least 80%, preferably at least 90%, more preferably at least 95%, of $Al_2O_3$ inclusions already existing in the steel into RE-oxygen-sulfide, wherein when a high-purity rare earth metal or alloy is added, a total oxygen content T[O]m of the molten steel is 25 ppm or less, a total sulfur content T[S]m of the molten steel is 90 ppm or less, and a total oxygen content T[O]r of the high-purity rare earth metal or alloy is controlled at 60-200 ppm. After the high-purity rare earth metal or alloy is added, RH deep vacuum circulation time satisfies the following formula (2):

$$T=(0.1\text{-}2.0)C_{RE}+T_0 \quad (2)$$

In the above, $C_{RE}$ is the content of rare earth elements in the steel, and $T_0$ is a correction constant, with a value of 3-10 min; and Ar gas soft blowing time satisfies the following formula (3):

$$t=(0.05\text{-}3.0)C_{RE}+t_0 \quad (3)$$

In the above, $C_{RE}$ is the content of rare earth elements in the steel, and to is a correction constant, with a value of 5-10 min.

The VD deep vacuum time refers to total time for degassing the molten steel after a certain vacuum degree in VD furnace is reached (usually 67 Pa or below);

The RH deep vacuum time refers to total time for degassing the molten steel after a certain vacuum degree in RH furnace is reached (usually 200 Pa or below).

Moreover, after the addition of the high-purity rare earth, a superheat of casting is increased by 5-15° C. compared with the steel containing the same components but without rare earth; and an N addition in the whole continuous casting is controlled within 8 ppm.

The present application further provides a control process of inclusions in ultra-clean rare earth steel, including:

1) guaranteeing white slag time to be 20 min or more, stable slag alkalinity to be greater than 5, a total sulfur content T[S]m to be 90 ppm or less, and a total oxygen content T[O]m to be 25 ppm or less during LF refining;
2) adding a high-purity rare earth metal or alloy before the LF departure or after at least 3 min of RH vacuum treatment, wherein a total oxygen content T[O]r in the high-purity rare earth metal or alloy is 60-200 ppm;

3) after adding the rare earth, making RH deep vacuum circulation time satisfy the following formula: $T=(0.1\text{-}2.0)C_{RE}+T_0$, where $C_{RE}$ is a content of rare earth elements in the steel, and $T_0$ is a correction constant, with a value of 3-10 min;

and making Ar gas soft blowing time satisfy the following formula: $t=(0.05\text{-}3.0)C_{RE}+t_0$, where $C_{RE}$ is a content (ppm) of rare earth elements in the steel, and to is a correction constant, with a value of 5-10 min, wherein the treatment time satisfying the above formula is quite beneficial for formation and float-up of rare earth-oxygen-sulfide, thereby reducing the number of inclusions;

4) strengthening gas tightness between a ladle, a tundish, and a crystallizer and also thickness of a covering agent on a liquid surface of the tundish in the continuous casting, strengthening argon purging on the liquid surface of the tundish, to avoid gas suction during the continuous casting, and controlling an N addition in the whole continuous casting to be within 8 ppm to inhibit the formation of metal nitride inclusions, wherein compared with the steel having the same components but without rare earth, a superheat of casting is increased by 5-15° C., for the purpose of preventing flocculation.

Preferably, the addition amount of high-purity rare earth in the step 3) satisfies $W_{RE}\geq\alpha\times T[O]m+T[S]m$, where a is a correction coefficient, with a value of 6-30, preferably 8-20, T[O]m is a total oxygen content in the steel, T[S]m is a total sulfur content in the steel, and $W_{RE}$ is an addition amount of the high-purity rare earth metal or alloy;

In the above, the T[O]r of the high-purity rare earth metal is controlled at 60-200 ppm, because when T[O]r is controlled at less than 60 ppm, the rare earth metal oxide is mainly formed, with an equivalent diameter of less than 2 μm, but when the T[O]r is increased to 200 ppm, the diameter of the rare earth metal oxide will be more than 10 μm, wherein the rare earth metal oxide can hardly float up, and will remain in the melt after solidification, thus deteriorating performance of the steel.

The present application further provides a control process of inclusions in ultra-low-RE bearing steel, wherein a process flow includes electric arc furnace smelting→LF refining→RH refining→continuous casting→heating→rolling, and steps are as follows:

1) electric arc furnace smelting;

2) LF refining: adjusting refining slag alkalinity to be greater than 5, and controlling T[O]m of 25 ppm or less and a total S content T[S]m of less than 90 ppm in the molten steel;

3) RH refining:

after performing RH vacuum treatment for at least 5 min, adding a high-purity rare earth metal or alloy, with an addition amount of the high-purity rare earth satisfying $W_{RE}\geq\alpha\times T[O]m+T[S]m$, where a is a correction coefficient, with a value of 6-30, preferably 8-20, T[O]m is a total oxygen content in the steel, T[S]m is a total sulfur content in the steel;

after adding the high-purity rare earth, making RH deep vacuum circulation time satisfy $T=(0.1\text{-}2.0)C_{RE}+T_0$, where $C_{RE}$ is a content of rare earth elements in the steel, and $T_0$ is a correction constant, with a value of 3-10 min; and making Ar gas soft blowing time satisfy the following formula: $t=(0.05\text{-}3.0)C_{RE}+t_0$, where $C_{RE}$ is a content of rare earth elements in the steel, and to is a correction constant, with a value of 5-10 min;

4) continuous casting: controlling an N addition in the whole continuous casting to be within 8 ppm, to prevent oxygen increase, and inhibit formation of metal nitride inclusions; and 5) rolling after heating and heat-treatment.

In the above, in the continuous casting, a superheat of casting is increased by 5-15° C. compared with the bearing steel having the same components but without RE, and an Al content at the end of RH refining is controlled to be 0.015-0.030%; in the continuous casting, a MgO content of an working lining of a tundish is greater than 85%, and $SiO_2$ contents of a long nozzle of laddle, a stopper rod of tundish, and a submerged nozzle are less than 5%.

In another aspect, the present application further provides a control method of inclusions in ultra-low-RE IF/DP/TRIP steel, including the following steps:

1) converter smelting;

2) RH refining: adding a high-purity rare earth metal after at least 2 min of RH deep vacuum, wherein before adding the high-purity rare earth, T[O]m in a molten steel is less than 25 ppm, and T[S]m is less than 50 ppm, and after adding the high-purity rare earth, making RH deep vacuum circulation time satisfy $T=(0.1\text{-}2.0)C_{RE}+T_0$, where $C_{RE}$ is a content of rare earth elements in the steel, and $T_0$ is a correction constant, with a value of 3-10 min; and making Ar gas soft blowing time after the vacuum broken satisfy the following formula: $t=(0.05\text{-}3.0)C_{RE}+T_0$, where $C_{RE}$ is a content of rare earth elements in the steel, and $T_0$ is a correction constant, with a value of 5-10 min;

3) continuous casting: ensuring gas tightness between a ladle, a tundish and a crystallizer, to avoid gas suction during the continuous casting, wherein an N addition in the whole continuous casting is less than 8 ppm; compared with the steel having the same components but without rare earth, a superheat of casting is increased by 5-15° C.; and 4) rolling and heat-treatment.

Preferably, top slag of a converter ladle is modified, and the content T[O]m of molten steel in the tundish is controlled to be 25 ppm or less; top slag of RH refining ladle is modified, and the S content of the molten steel before RH refining is controlled to be 0.005% or less; and tundish top slag is modified in the continuous casting. Through three modification processes, the fluidity of the slag is improved, the capability of removing the inclusions is improved, and the cleanness of the steel is ensured.

Besides, the present application provides a control process of inclusions in ultra-low-RE and ultra-high-strength steel, wherein a process flow is: converter smelting-LF refining-RH refining-continuous casting-rolling-quenching and tempering, and includes the following steps:

1) converter smelting:

2) LF and RH refining:

before adding the rare earth, in the LF refining, ensuring white slag time to be 20 min or more, and a molten steel to have a total oxygen content T[O]m of less than 20 ppm, and T[S]m of less than 0.005%;

adding rare earth before the LF departure or after 3 min of RH net circulation;

after adding the rare earth, making RH deep vacuum circulation time satisfy $T=(0.1\text{-}2.0)C_{RE}+T_0$, where $C_{RE}$ is a content of rare earth elements in the steel, and $T_0$ is a correction constant, with a value of 3-10 min, after conventional Ca treatment at a RH negative pressure, making Ar gas soft blowing time satisfy the following formula: $t=(0.05\text{-}3.0)C_{RE}+T_0$, where $C_{RE}$ is a content of rare earth elements in the steel, and to is a correction constant, with a value of 5-10 min;

3) continuous casting: ensuring gas tightness between a ladle, a tundish and a crystallizer, controlling an N addition in the whole continuous casting to be within 8 ppm; and controlling the superheat of casting to be increased by 5-15° C. compared with the steel having the same components but without rare earth; and 4) rolling and tempering processes.

It should be pointed out that there are three reasons for important changes of the inclusions in the steel in the present application. One is that the RE has strong affinity with oxygen and sulfur, then it is easy to rapidly form the RE-oxygen-sulfide/RE-sulfide, and meanwhile, most of the existing $Al_2O_3$ inclusions are modified into the RE-oxygen-sulfide; the second one is that in the process of molten steel refining, the rare earth-oxygen-sulfide/rare earth-sulfide formed by argon soft blowing partially float up, thereby reducing the number of inclusions; and the third one is that as the oxygen content in the melt is low, the rare earth-oxygen-sulfide is not easy to grow up, and has good wettability with the steel melt, then it is not easy to gather together.

A reaction formula of modification of the present application is as follows:

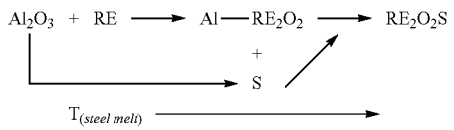

The present application has the following prominent technical effects:

(1) the mechanism of modifying inclusions in the high-purity steel by adding the high-purity rare earth is clearly determined, and a scientific and systematic control method of inclusions in high-purity steel is provided, then on this basis, the modification of the high-purity steel by the high-purity rare earth can be promoted and applied to the development of more high-performance steel types, for example, high-level bearing, gear, mold, stainless steel, steel for nuclear power, steel for automobile, and various key components, of which the effect is equivalent to microstructure control in steel;

(2) the hardness of the RE-oxygen-sulfide inclusions in the rare earth-modified steel is lower than that of the $Al_2O_3$ inclusions, and has good plastic deformation capability, which results in low micro-stress/strain concentration at the boundary, and reduces the possibility of crackage caused by strain concentration, wherein the fatigue life of the RE-modified high-purity bearing steel is increased to $4.1*10^8$ times, which is more than 40 times that of the existing high-purity bearing steel, and the rolling contact fatigue life reaches $3.08*10^7$, which is 910 ten thousand times higher than that of the existing high-purity bearing steel, thus the fatigue life of the RE-modified steel is significantly improved; compared with the conventional IF steel, the RE-IF steel has the r value significantly improved by 25%, and meanwhile obviously improved the elongation and the product of strength and ductility, without changing the strength thereof; compared with the high-strength steel without addition of RE, the ultra-high-strength steel is comprehensively improved in low-temperature transverse and longitudinal impact energies in the range of 0° C. to −40° C. after the addition of ultra-low content RE;

(3) by specifying that the rare earth content REM in the ultra-clean rare earth steel, the total oxygen content in the molten steel, and the total oxygen content in the rare earth metal or alloy added to the steel satisfy the above formula, it is controlled to obtain that the RE-oxygen-sulfide ($RE_2O_2S$) accounts for 50% or more of the total number of inclusions, rather than the rare earth oxide ($RE_2O_3$) predominating, and the size of the RE-oxygen-sulfide is minimized, and the RE-oxygen-sulfide with an equivalent diameter of 1-5 μm, in a spherical shape, a spheroidal shape or a granular shape, and in dispersed distribution can be obtained; and (4) when adding the rare earth, the total oxygen content T[O]m of 25 ppm or less and the total sulfur content T[S]m of 90 ppm or less in the molten steel, the oxygen content, the addition amount and the addition timing of the high-purity rare earth, the RH refining time after adding the high-purity rare earth, the Ar gas soft blowing time, the superheat of casting and the N addition in the whole continuous casting are controlled, so that the formed RE-oxygen-sulfide sufficiently floats up, and the number of inclusions is reduced. The synergistic effect of these process control points together ensure modification of the inclusions in the steel, finally, at least 80% of the $Al_2O_3$ inclusions already existing in the steel are modified into RE-oxygen-sulfide, and the RE-oxygen-sulfide with a small size (1-5 μm), in a spherical shape, a spheroidal shape or a granular shape, and in dispersed distribution is obtained.

Figure 1:
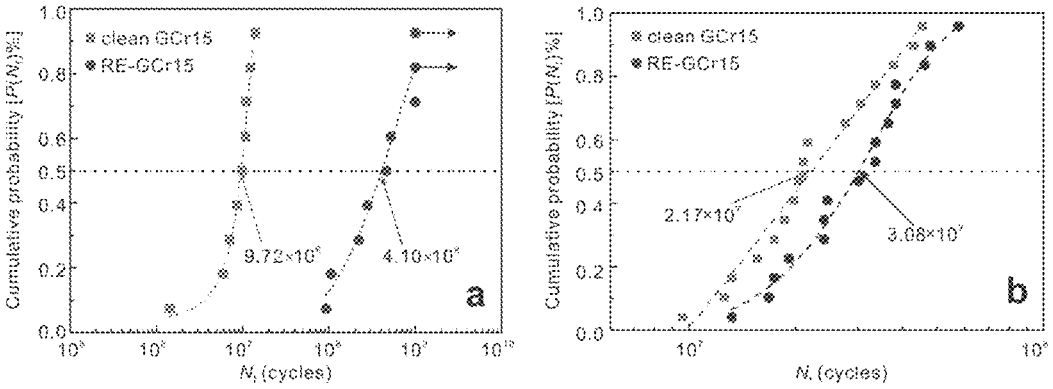
FIG. 1: effect of rare earth addition on tension-compression fatigue and rolling contact fatigue properties of bearing steel GCr15, wherein (a) shows the tension-compression fatigue life at a maximum stress load of ±800 MPa (2 Khz); and (b) shows the rolling contact fatigue life of the bearing steel at a load Fa of 8.82 KN and a rotating speed of 2000 r/min.

(b) shows a comparison of nano-indentation test of rare earth-oxygen-sulfide and $Al_2O_3$;

(c) shows SEM topography of the inclusions in the conventional GCr15 clean steel (without REM);

(d) shows SEM topography of rare earth-oxygen-sulfide in the RE-GCr15 clean steel of the present application;

(e) shows topography and diffraction pattern of the rare earth-oxygen-sulfide in the RE-GCr15 clean steel of the present application under TEM; and (f)-(g) show the inclusions and dislocation blocks around them after fatigue failure of the RE-GCr15 clean steel of the present application.

DETAILED DESCRIPTION OF THE PRESENT INVENTION

The present application is further described below in combination with specific embodiments, but the scope of protection of the present application is not limited thereto.

Example 1

The present example provides a method of modifying inclusions in RE-GCr15 bearing steel, wherein a process flow is electric arc furnace smelting→LF refining→RH refining→continuous casting→heating→rolling, and includes the following steps:

1) electric arc furnace smelting;
2) LF refining: reasonably adjusting a refining slag system, stabilizing slag alkalinity to be greater than 5, ensuring white slag time to be 20 min or more, and controlling molten steel to have T[O]m of 10 ppm or less and content T[S]m to be not higher than 0.005%;
3) RH refining: adding a high-purity rare earth metal to an overhead bin after at least 5 min of RH vacuum treatment, with an addition amount of the high-purity rare earth satisfying the following formula:

$$W_{RE} \geq \alpha \times T[O]m + T[S]m,$$

where $\alpha$ is a correction coefficient, with a value of 6-30, preferably 8-20, T[O]m is a total oxygen content (ppm) in the steel, and T[S]m is a total sulfur content (ppm) in the steel;

controlling T[O]r of the high-purity rare earth metal to be 60-200 ppm, ensuring RH deep vacuum circulation time to be 10 min or more after adding the high-purity rare earth metal, ensuring Ar gas soft blowing time to be 10 min or more, so that formed rare earth-oxygen-sulfide floats up, thereby reducing the number of inclusions, and controlling Al element content at the end of RH refining to be 0.015-0.030%, and rare earth element content in the molten steel to be 15-30 ppm;

4) strengthening gas tightness between a ladle, a tundish and a crystallizer and thickness of a covering agent on a liquid surface of the tundish in continuous casting, strengthening argon purging on the liquid surface of the tundish, to avoid gas suction during the continuous casting, controlling an N addition in the whole continuous casting to be within 8 ppm, to inhibit formation of TiN inclusions, and ensuring the purity of steel; controlling a superheat of casting to be 25-40° C., wherein the superheat controlled is increased by 5-20° C. than that of the conventional superheat control, with the purpose of preventing flocculation; controlling an MgO content of an working lining of the tundish to be more than 85%, and an $SiO_2$ contents in a ladle long nozzle, a tundish stopper rod and a submerged nozzle to be less than 5%, to ensure compactness and corrosion resistance of the tundish and also erosion resistance and corrosion resistance of the three main components; and performing constant casting speed in the continuous casting; and
5) a conventional rolling process.

A plurality of samples were extracted from rolled products obtained in the present example, and the inclusions in the modified GCr15 steel were analyzed. Results show that: compared with the high-purity GCr15 steel without addition of rare earth, the modification of inclusions by adding the high-purity rare earth enables the RE-GCr15 steel to generate unprecedented excellent fatigue property, as shown in FIG. 1*a*, the addition of rare earth elements changes the law of the fatigue life, in the cyclic load tension/compression experiments of maximum stress of ±800 MPa and 20 kHz, the tension-compression fatigue life of the RE-GCr15 steel is improved to $4.1*10^8$ times and is more than 40 times that of the high-purity GCr15 steel (the tension-compression fatigue life reported on the literature is about $10*10^6$ times), and the addition of rare earth reduces the number of inclusions by 50% or more [FIG. 2(*a*)] and reduces the inclusions of 5 μm or more by at least 35%. In addition, as another important index of the bearing steel, the rolling contact fatigue life of the RE-GCr15 steel in FIG. 1*b* is also greatly improved. Under the conditions of an axial load Fa of 8.82 KN and a rotating speed of 2000 r/min, the rolling contact fatigue life of the RE-GCr15 steel is $3.08\times10^7$, which is 910 ten thousand times higher than that of the high-purity GCr15 steel.

Figure 2:
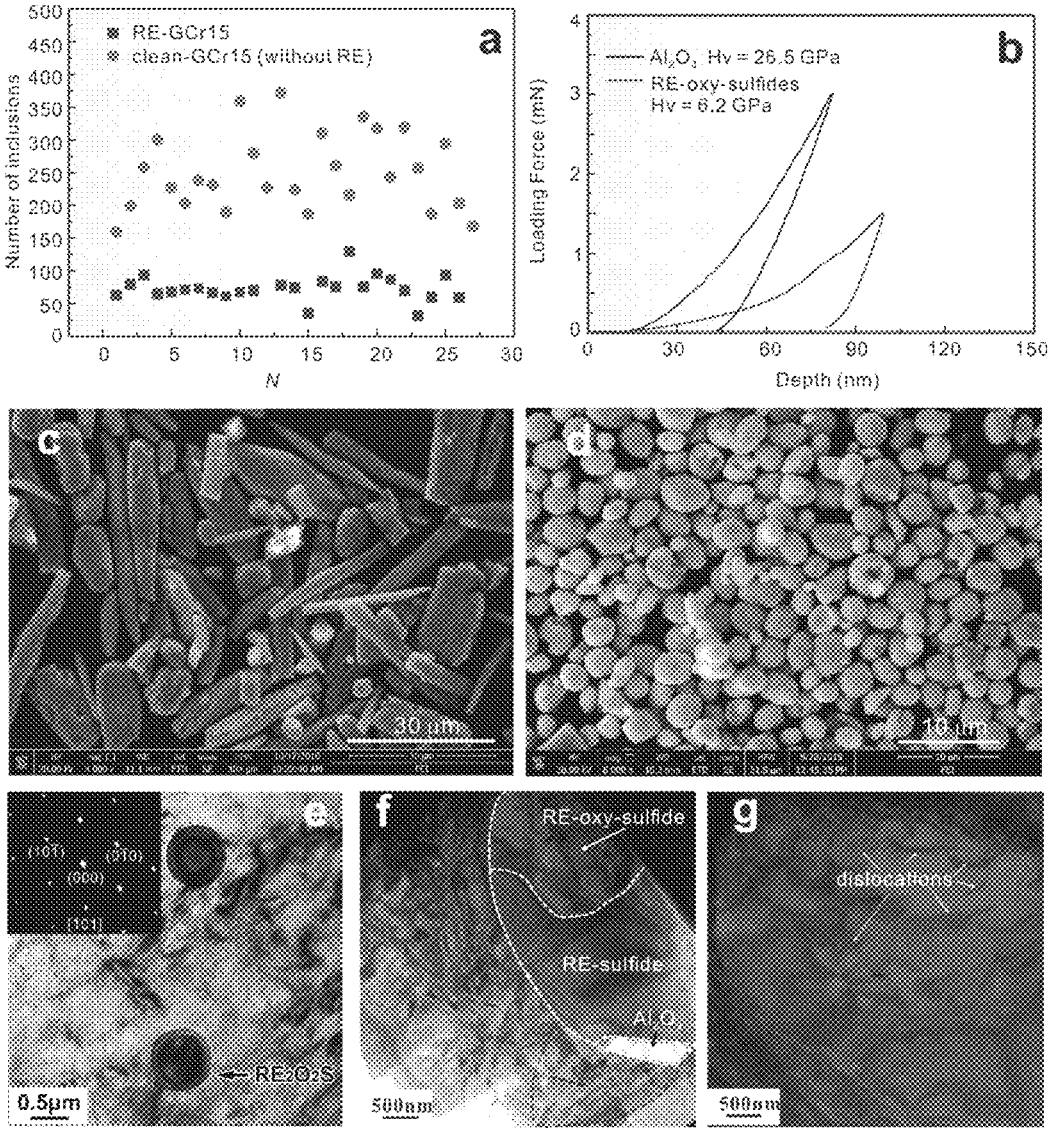
FIG. 2: effects of the rare earth on the modification of the inclusions, including mechanical properties of the inclusions, morphology and distribution of the inclusions, and morphology and distribution of the inclusions after fatigue failure, wherein (a) shows a comparison of statistics of the number of inclusions in the conventional GCr15 and RE-GCr15 steel ingots of the present application.

Conventional hard brittle $Al_2O_3$ oxides and strip-shaped MnS inclusions (>100 μm) are quite common in the high-purity GCr15 steel [FIG. 2(*c*)], whereas for rare earth-modified GCr15 steel, these conventional inclusions disappear dramatically, and are replaced by small-sized, spherical, dispersed Re-oxygen-sulfide and RE-sulfide with high typicality and regularity [FIG. 2(*d*)]. Further TEM observation shows that most of these rare earth-oxygen-sulfide inclusions are $RE_2O_2S$ with a gentle boundary with the Fe matrix [FIG. 2(*e*)].

The $RE_2O_2S$ inclusions have much lower elasticity, Young's modulus, shear modulus and hardness than the conventional $Al_2O_3$ inclusions, and these results are also confirmed by the current nano-indentation experiment measurements [FIG. 2(*b*)]. As the $RE_2O_2S$ inclusions have better compatibility with the Fe matrix than the conventional hard $Al_2O_3$ inclusions, the non-uniform degree of internal micro-stress and strain concentration will be far lower than that of the conventional steel. As shown by the results of EDS and/or selected area diffraction patterns shown in f of FIG. 2, the composite inclusions consist of RE-O—S inclusions (≥85%) and/or O—Al—S-RE inclusions, rare earth-sulfide (≥10%), and a very small amount (≤5%) of $Al_2O_3$ inclusions (FIG. 2(*f*)), and after the tension-compression loading circulation, many dislocations appear inside the rare earth-oxygen-sulfide inclusions (FIG. 2(*g*), but laths in the matrix in the vicinity of the rare earth-oxygen-sulfide and the rare earth-sulfide are still intact, and boundaries between the laths are still clear; in contrast, $Al_2O_3$ particles almost have no dislocation inside, the laths crack, and the boundaries between them disappear. This comparison indicates that the rare earth-oxygen-sulfide has lower hardness than the $Al_2O_3$ inclusions and better plastic deformability, resulting in lower micro-stress/strain concentration at the boundaries, further reducing the cracking probability caused by strain concentration.

Example 2

The present example provides a method of modifying $Al_2O_3$ inclusions in IF steel, wherein a process flow is: molten iron reladling station—molten iron pretreatment—converter smelting—RH refining—continuous casting—hot rolling—acid pickling—cold rolling—annealing, and includes the following steps:

1) converter smelting:

in the converter procedure, modifying ladle top slag, meanwhile without pre-deoxygenation and alloying of manganese in the converter procedure and an RH decarburization process, strictly controlling an oxygen content of molten steel to be 25 ppm or less in tundish, so as to improve the cleanness of IF steel; and strictly controlling a tapping temperature, a ladle temperature and a slag amount;

2) RH refining:

modifying the ladle top slag in an RH refining process, and controlling an S content of the molten steel to be 0.003% or less when entering the RH refining; controlling the oxygen content before entering the RH refining and also before adding the high pure rare earth but after deoxygenation and alloying, wherein the total oxygen content T[O]m was not more than 20 ppm, and T[S]m was not more than 30 ppm in the molten steel before adding the high-purity rare earth; after vacuum decarburization, deoxygenation and alloying, and after at least 2 min of RH deep vacuum, adding the high-purity rare earth with a total oxygen content of 60-100 ppm to an overhead bin, after adding the high-purity rare earth, making RH deep vacuum bottom argon blowing time not less than 10 min, and negative pressure soft blowing time not less than 15 min after the vacuum being broken;

3) technical requirements in the continuous casting step:

modifying the tundish top slag, and ensuring the tightness between the ladle, the tundish and the crystallizer, to avoid gas suction in the continuous casting process, and controlling the N addition in the whole continuous casting to be less than 8 ppm, wherein the superheat of casting was controlled to be increased by 5-15° C. compared with the conventional superheat, preventing the risk of flocculation; and controlling a constant casting speed in the continuous casting; and 4) conventional rolling and heat treatment processes.

A plurality of samples were extracted from annealed products obtained in the present example, and the modified IF steel was analyzed in detail in terms of components, gas content, morphology and size distribution of inclusions, and so on:

TABLE 1

Components and Contents of IF Steel

| Serial No. | C | Si | Mn | P | T[S]m | Al | Ti | T[O]m | REM |
|---|---|---|---|---|---|---|---|---|---|
| Comparative Example 1 | 0.001-0.004 | 0.005-0.05 | 0.01-0.25 | ≤0.01 | ≤0.003 | 0.01-0.05 | 0.01-0.09 | ≤0.0015 | — |
| Example 2-1 | 0.001-0.004 | 0.005-0.05 | 0.01-0.25 | ≤0.01 | ≤0.003 | 0.01-0.05 | 0.01-0.09 | ≤0.0015 | 15-20 |

Note:

except that RE is in ppm, all of other elements are in wt %, and the balance is Fe and inevitable impurity elements; the components and the preparation and control process of Comparative Example 1 are the same as those of Example 2-1, but without REM.

TABLE 2

Typical Size and Number Distribution of Inclusions in IF Steel

| Serial No. | Total number | Number of fields | 1-2 μm number and proportion | 2-5 μm number and proportion | 5-10 μm number and proportion |
|---|---|---|---|---|---|
| Comparative Example 1 | 150 | 20 | 130 (86.67%) | 19 (12.67%) | 1 (0.66%) |
| Example 2-1 | 225 | 22 | 213 (94.67%) | 11 (4.89%) | 1 (0.44%) |

TABLE 3

Typical Size and Number Distribution of Inclusions in IF Steel (continued Table 2)

| Serial No. | Dmax/μm | Dmin/μm | Dmean/μm | Dmax/Dmin | Area proportion |
|---|---|---|---|---|---|
| Comparative Example 1 | 1.890 | 1.027 | 1.464 | 1.841 | 0.146 |
| Example 2-1 | 1.817 | 1.044 | 1.431 | 1.741 | 0.139 |

In the present example, an appropriate amount of high-purity rare earth metal is added to the IF steel, then on the one hand, the number of fine inclusions of 1-2 μm level in the steel can be significantly increased by 8% (namely, from 86.67% to 94.67%), the number and proportion of fine inclusions of 5-10 μm level can be obviously decreased, the maximum diameter (1.464 μm→1.431 μm) of the inclusions can be slightly decreased, and compared with the IF steel without addition of rare earth, the number of inclusions (area proportion 0.146→0.139) is obviously decreased; on the other hand, adding an appropriate amount of RE to the IF steel can achieve the purpose of obviously modifying the inclusions, and in conjunction with SEM+EDS analysis, it is found that RE can modify large-size rod-like/clustered $Al_2O_3$ inclusions into O—Al—S-RE/RE-O—S compounds in a spheroidal shape, with finer size and in dispersed distribution; meanwhile, TiN and MnS inclusions lose the $Al_2O_3$ nucleation matrix, thus it is difficult for the nucleation to grow large, thereby reducing the cleavage effect and anisotropy of such inclusions on the matrix.

The distribution of the inclusions in the steel of Example 2-1 are characterized in that, in 22 fields, the total number of inclusions is less than 250, wherein the proportion of the inclusions with an equivalent diameter of 1-2 μm is 94.5% or greater, the proportion of the inclusions with an equivalent diameter of 2-5 μm is less than 5%, and the proportion of the inclusions with an equivalent diameter of 5-10 μm is less than 0.5%.

In conjunction with the testing results of tension test of JIS-5 sheet standard samples, it is confirmed that compared with the conventional IF steel, the RE-IF steel has the r value significantly increased by at least 25% (1.820→2.267), and meanwhile obviously improved the elongation and the product of strength and ductility without substantially changing the strength thereof.

TABLE 4

Typical Property Indexes of IF Steel

| Serial No. | $Rp_{0.2}$/Mpa | Rm/Mpa | $Rp_{0.2}$/Rm | A50/% | $r_{90/15}$ | $n_{10-20}$ | Product of strength and ductility/MPa · % |
|---|---|---|---|---|---|---|---|
| Comparative Example 1 | 115.63 | 312.08 | 0.37 | 44.72 | 1.820 | 0.261 | 13957 |
| Example 2-1 | 99.28 | 294.67 | 0.34 | 50.36 | 2.267 | 0.269 | 14839 |

Example 3

The present example provides a method of modifying inclusions in ultra-high-strength F grade marine steel, wherein a process flow is: molten iron pretreatment—converter smelting LF refining—RH refining—continuous casting—rolling—quenching and tempering, and a control process is as follows:

1) smelting and rare earth addition parts: before adding the rare earth, ensuring white slag time in the LF refining to be 20 min or more, the molten steel to have a total oxygen content T[O]m of not higher than 10 ppm, and a content T[S]m not higher than 0.003%; adding the high-purity rare earth metal before the LF departure or after 3 min of RH net circulation, wherein the rare earth was added in a form of being cladded by a steel pipe of the same material or wrapped by an aluminum foil to the molten steel, for the purpose of avoiding oxidation or contacting with the steel slag during the addition of rare earth metal, the total oxygen content in the rare earth metal was 80-100 ppm, wherein the addition amount of rare earth in Example 3-2 was 2 times that in Example 3-1, and the rare earth of Example 3-2 could be added in two times;
2) after adding the rare earth, ensuring the RH deep vacuum time to be 15 min or more, after conventional Ca treatment at an RH negative pressure, ensuring the Ar gas soft blowing time to be 15 min or more;
3) in the continuous casting process, ensuring gas tightness between a ladle, a tundish and a crystallize, to avoid gas suction in the continuous casting process, and controlling the N addition in the whole continuous casting to be less than 5 ppm; and controlling the superheat of casting and the constant casting speed in the continuous casting, wherein the superheat was controlled to be increased by 5-15° C. compared with the conventional superheat; and
4) conventional rolling and tempering processes.

Through the above process control, a plurality of samples were extracted from tempered products obtained in the present example, and the modified ultra-high-strength steel was analyzed in detail in terms of component, gas content, morphology and size distribution of inclusions and so on:

TABLE 5

Components and Contents of Ultra-high-strength Steel

| Serial No. | C | Si | Mn | P | T[S]m | Nb | Ni | Al | B | T[O]m | REM |
|---|---|---|---|---|---|---|---|---|---|---|---|
| Comparative Example 2 | 0.05-0.12 | 0.30-0.60 | 1.2-1.8 | ≤0.01 | ≤0.003 | 0.10-0.20 | 0.3-0.8 | 0.01-0.04 | 0.001-0.005 | ≤0.0010 | — |
| Example 3-1 | 0.05-0.12 | 0.30-0.60 | 1.2-1.8 | ≤0.01 | ≤0.003 | 0.10-0.20 | 0.3-0.8 | 0.01-0.04 | 0.001-0.005 | ≤0.0010 | 15-20 |
| Example 3-2 | 0.05-0.12 | 0.30-0.60 | 1.2-1.8 | ≤0.01 | ≤0.003 | 0.10-0.20 | 0.3-0.8 | 0.01-0.04 | 0.001-0.005 | ≤0.0010 | 30-40 |

Note: except that RE is in ppm, all of other elements are in wt %, and the balance is Fe and inevitable impurity elements; the components and the preparation and control process of Comparative Example 2 are the same as those of Example 3-1 and Example 3-2, but without REM.

TABLE 6

Typical Size Distribution of Inclusions in Ultra-high-strength Steel

| Serial No. | Total number | Number of fields | 1-2 μm number and proportion | 2-5 μm number and proportion | 5-10 μm number and proportion | >10 μm number and proportion |
|---|---|---|---|---|---|---|
| Comparative Example 2 | 529 | 20 | 34 (6.43%) | 358 (67.67%) | 122 (23.06%) | 15 (2.84%) |
| Example 3-1 | 400 | 20 | 47 (11.75%) | 248 (62.00%) | 86 (21.5%) | 19 (4.75%) |
| Example 3-2 | 456 | 20 | 48 (10.53%) | 286 (62.72%) | 102 (22.37%) | 20 (4.39%) |

TABLE 7

Typical Size Distribution of Inclusions in Ultra-high-strength Steel (continued Table 6)

| Serial No. | Dmax/ μm | Dmin/ μm | Dmean/ μm | Dmax/ Dmin | Area proportion/‰ |
|---|---|---|---|---|---|
| Comparative Example 2 | 34.40 | 1.78 | 4.37 | 19.33 | 0.45 |
| Example 3-1 | 31.46 | 1.78 | 4.02 | 17.67 | 0.36 |
| Example 3-2 | 19.53 | 1.78 | 4.21 | 10.97 | 0.37 |

Study results indicate that as the addition amount of RE increases, the maximum diameter Dmax of the inclusions gradually decreases (34→31→19), and that the number of inclusions with a diameter of less than 2 μm increases by at least 4%, the total number of inclusions decreases by a mean of 18% (0.45% c→0.37% o); after the addition of RE, the mean equivalent diameter $D_{mean}$ of the inclusions is reduced by 8% (4.37-4.02), the maximum/minimum inclusion diameter is obviously reduced, and the area proportion of the inclusions is also reduced to different degrees.

Typical distribution of the inclusions in the steel of Example 3-1 and Example 3-2 is as follows: in 20 fields, the total number of inclusions is less than 500, wherein the proportion of the inclusions with an equivalent diameter of 1-2 μm is greater than 10.5%, the proportion of the inclusions with an equivalent diameter of 2-5 μm is 60-80%, the proportion of the inclusions with an equivalent diameter of 5-10 μm is less than 22.5%, and the proportion of the inclusions with an equivalent diameter of less than 10 μm is less than 5%.

In conjunction with the SEM+EDS analysis, there were large-sized $Al_2O_3$ cluster inclusions in the field of samples without adding RE, in which the large-size inclusions were comminuted, accompanied by strip-shaped MnS inclusions, while the inclusions in the samples of Example 3-1 and Example 3-2 with REM were mostly spherical or granular RE-O—S compounds, with a smaller size and in dispersed distribution.

TABLE 8

Typical Microstructure Comparison of Ultra-high-strength Steel

| Category | Surface structure | Structure at position of ¼ plate thickness | Structure at position of ½ plate thickness |
|---|---|---|---|
| Comparative Example 2 | a small amount of bainite and ferrite | presence of microsegregation | P + F biphase |
| Example 3-1 | bainite | slight microsegregation | P + F biphase |
| Example 3-2 | increased content of bainite-like structure, and better structure uniformity from surface to center | Slight microsegregation | P + F biphase |

TABLE 9

Typical Low Temperature Transverse and Longitudinal Impact Properties of Ultra-high-strength Steel

| | Transverse impact energy/J | | | Longitudinal impact energy/J | | |
|---|---|---|---|---|---|---|
| Category | 0° C. | −20° C. | −40° C. | 0° C. | −20° C. | −40° C. |
| Comparative Example 2 | 35 | 17 | 11 | 32 | 15 | 9 |

TABLE 9-continued

Typical Low Temperature Transverse and Longitudinal Impact Properties of Ultra-high-strength Steel

| | Transverse impact energy/J | | | Longitudinal impact energy/J | | |
|---|---|---|---|---|---|---|
| Category | 0° C. | −20° C. | −40° C. | 0° C. | −20° C. | −40° C. |
| Example 3-1 | 65 | 30 | 18 | 93 | 52 | 18 |
| Example 3-2 | 80 | 45 | 30 | 102 | 74 | 45 |

Note: All the samples in Table 9 were taken at positions of ½ plate thickness.

The above analysis results indicate that, in the range of 0° C. to −40° C., compared with the F grade ultra-high-strength marine steel without addition of RE, the modification effect of the addition of an appropriate amount of high-purity rare earth metal on the inclusions can allow the low-temperature transverse and longitudinal impact energies of the F grade ultra-high-strength marine steel to be fully improved: at 0° C., the transverse impact energy is increased by at least 30 J, and the transverse impact energy is increased by at least 60 J; at −20° C., the transverse impact energy is increased by at least 13 J, and the longitudinal impact energy is increased by at least 35 J; at −40° C., the transverse impact energy is increased by at least 5 J, and the longitudinal impact energy is increased by at least 9 J; in particular, the improvement effect at the positions of ½ plate thickness is especially remarkable.

The examples above are merely preferred embodiments of the present application, but should not be construed as limitation on the scope of protection of the present application. It should be indicated that a person ordinarily skilled in the art still could make several modifications, substitutions and improvements without departing from the concept of the present application, all of which fall within the scope of protection of the present application.

The invention claimed is:

1. A control process of inclusions in ultra-clean rare earth steel, wherein the content of rare earth elements REM in the ultra-clean rare earth steel, the total oxygen content T[O]m, the total sulfur content T[S]m in the steel, and the total oxygen content T[O]r in a rare earth metal or alloy added to the steel are controlled to satisfy the following formula:

$-500<REM-(m*T[O]m+n*T[O]r+k*T[S]m)<-30$, where REM is the content of rare earth elements in the steel, in ppm;

T[O]m is a total oxygen content in the steel, in ppm;

T[O]r is a total oxygen content in a rare earth metal or alloy added to the steel, in ppm;

T[S]m is a total sulfur content in the steel, in ppm;

m is the first correction coefficient, with a value of 2-4.5;

n is the second correction coefficient, with a value of 0.5-2.5;

k is the third correction coefficient, with a value of 0.5-2.5; and the process comprises:

a) guaranteeing white slag time to be 20 min or more, stabling slag alkalinity to be greater than 5, a total sulfur content T[S]m to be 90 ppm or less, and a total oxygen content T[O]m to be 25 ppm or less during LF refining;

b) adding a high-purity rare earth metal or alloy before the LF refining departure or after at least 3 min of RH vacuum treatment, wherein a total oxygen content T[O]r in the high-purity rare earth metal or alloy is 50-200 ppm;

c) after adding the high-purity rare earth metal or alloy, making RH or VD deep vacuum circulation time satisfy the following formula: $T=(0.1\text{-}2.0)C_{RE}+T_0$, where $C_{RE}$ is a content in ppm of rare earth elements in the steel, and $T_0$ is a correction constant, and $T_0$ has a value of 3-10 min; and making Ar gas soft blowing time satisfy the following formula: $t=(0.05\text{-}3.0)C_{RE}+t_0$, where $C_{RE}$ is a content in ppm of rare earth elements in the steel, and $t_0$ is a correction constant and $t_0$ has a value of 5-10 min, ensuring the RH deep vacuum circulation time to be 10 minutes or more after adding the high-purity rare earth metal, ensuring the Ar gas soft blowing time to be 10 minutes or more, wherein the Ar gas soft blowing time is controlled so that the formed RE-oxygen-sulfide floats up, and the number of inclusions is reduced; and wherein the VD deep vacuum circulation time refers to a total time for degassing the molten steel after a vacuum degree equal to 67 Pa or below in a VD furnace is reached; and the RH deep vacuum circulation time refers to a total time for degassing the molten steel after a vacuum degree equal to 200 Pa or below in a RH furnace is reached; and d) strengthening gas tightness between a ladle, a tundish and a crystallizer and thickness of a covering agent on a liquid surface of the tundish in the continuous casting, strengthening argon purging on the liquid surface of the tundish and controlling a N addition in the whole continuous casting to be within 8 ppm, wherein compared with a steel having the same composition but without rare earth elements, a superheat of casting is increased by 5-15° C.

2. The process according to claim 1, wherein the obtained steel contains 10-200 ppm of rare earth elements, wherein 50% or more of total number of inclusions in the steel are RE-oxygen-sulfides ($RE_2O_2S$) with a mean equivalent diameter $D_{mean}$ of 1-5 μm in a spherical shape or a spheroidal shape or a granular shape, and in dispersed distribution.

3. The process according to claim 2, wherein the content of RE-oxygen-sulfides ($RE_2O_2S$) accounts for 80% or more of total number of inclusions in the steel.

4. The process according to claim 2, wherein at least 90% of $Al_2O_3$ inclusions in the steel are modified into RE-oxygen-sulfides ($RE_2O_2S$).

5. The process according to claim 2, wherein at least 95% of $Al_2O_3$ inclusions in the steel are modified into RE-oxygen-sulfides ($RE_2O_2S$).

6. The process according to claim 1, wherein the steel contains 10-100 ppm of rare earth elements.

7. The process according to claim 1, wherein the steel contains 10-50 ppm of rare earth elements.

8. The process according to claim 1, wherein the mean equivalent diameter $D_{mean}$ of RE-oxygen-sulfide ($RE_2O_2S$) in the steel is 1-2 μm.

9. The process according to claim 1, wherein the steel is high-level bearing steel, gear steel, mold steel, stainless steel, steel for nuclear power, steel for automobile or ultra-high-strength steel.

10. The process according to claim 1, wherein the total number of inclusions in the steel comprise 50% or more of rare earth-oxygen-sulfides ($RE_2O_2S$), 50% or less of rare earth-sulfides, and 0-10% of $Al_2O_3$ inclusions.

11. The process according to claim 10, wherein the total number of inclusions in the steel comprise 85% or more of rare earth-oxygen-sulfides ($RE_2O_2S$), 10% or less of rare earth-sulfides, and 5% or less of $Al_2O_3$ inclusions.

* * * * *